United States Patent [19]

Thompson et al.

[11] 4,396,354

[45] Aug. 2, 1983

[54] CRYOGENIC PUMP AND METHOD FOR PUMPING CRYOGENIC LIQUIDS

[75] Inventors: David R. Thompson, Kenmore; Boris Pevzner, Williamsville, both of N.Y.

[73] Assignee: Union Carbide Corporation, Danbury, Conn.

[21] Appl. No.: 202,475

[22] Filed: Oct. 31, 1980

[51] Int. Cl.[3] ..... F04B 15/08; F04B 39/08

[52] U.S. Cl. ..... 417/53

[58] Field of Search ..... 417/901, 53, 439; 62/55.5; 92/144

[56] References Cited

U.S. PATENT DOCUMENTS

| | | | |
|---|---|---|---|
| 2,292,617 | 8/1942 | Dana | 103/153 |
| 2,730,957 | 1/1956 | Riede | 103/153 |
| 2,837,898 | 6/1958 | Ahlstrand | 62/1 |
| 2,888,879 | 6/1959 | Gaarder | 103/153 |
| 2,931,313 | 4/1960 | Hughes | 417/901 X |
| 3,011,450 | 12/1961 | Tyree, Jr. | 417/439 X |
| 3,136,136 | 6/1964 | Gottzmann | 62/55 |
| 3,263,622 | 8/1966 | Tyree, Jr. | 103/153 |
| 4,156,584 | 5/1979 | Schuck | 417/435 |

*Primary Examiner*—William L. Freeh

*Attorney, Agent, or Firm*—Eugene Lieberstein

[57] ABSTRACT

The cryogenic pump is of the reciprocating type using a differential diameter piston assembly having a reciprocating piston and piston rod in which the piston is of a diameter larger than the piston rod so as to form a variable volume annulus within the pumping chamber about the piston rod. The pumping chamber is surrounded with a cooling jacket connected by a passageway to the variable volume annulus. Blow by fluid is collected in the variable volume annulus during each suction stroke of the reciprocating piston and passed into the cooling jacket during each discharge stroke so as to cause collected blow by liquid in the cooling jacket to flash during consecutive discharge strokes.

11 Claims, 6 Drawing Figures

CRYOGENIC PUMP AND METHOD FOR PUMPING CRYOGENIC LIQUIDS

This invention relates to a method and apparatus for pumping a highly volatile liquid having a boiling point temperature at atmospheric pressure, substantially below 273° K. More specifically this invention relates to an improved reciprocating type cryogenic pump for pumping cryogenic liquids such as liquefied nitrogen or oxygen and particularly at high pressure and flow rate.

The pumping of cryogenic liquids presents some difficult problems. Most of these problems stem from the relatively unique physical properties of cryogenic liquids, such as their high compressibility and volatility, as well as the low temperatures involved. While the prior art has minimized many of these problems in low pressure and/or low flow cryogenic pumps, the prior art has been unable to provide a "high flow" and/or "high pressure cryogenic pump" having a "high volumetric efficiency" and a "low required net position suction head" (NPSH). In this context, "high flow" refers to cryogenic pumping rates in excess of about 15 gal./min./pumping chamber at pumping conditions. Also in this context, the term "high pressure cryogenic pump" is meant to include pumps which provide the pumped liquid at pressures above about 500 psig. And for purposes of this invention, the term "high volumetric efficiency" means volumetric efficiences above about 80%. Volumetric efficiency is defined as the ratio of the actual pump capacity to the volume displaced by the piston per unit time times 100 percent. Finally, the term "low required NPSH" means a required NPSH below about 10 psid.

It has long been recognized by those skilled in cryogenic pump technology that the following items congribute significantly to the inefficiency of a reciprocating cryogenic pump: heat conduction from the pump warm end to the pumping chamber; frictional heat generated by the reciprocating piston motion in the pumping chamber; and heat released in the pumping chamber due to fluid compression.

The prior art is replete with various designs to control the above identified heat effects at their source. Designs which purportedly insulate the pumping chamber from the pump warm end, and which reduce frictional effects between the reciprocating piston and the pump body are available. While many of these solutions are appropriate for low pressure and/or low flow designs, they are not entirely satisfactory for the high pressure and high flow design.

The combination of high flow and high pressure exacerbates heat management problems at the cold end of the pump. Under such operating conditions, the frictional heat generated by the reciprocating action of the piston together with that heat released during fluid compression, increase substantially relative to low pressure and/or low flow cryogenic pumps. This higher heat generation causes increased vapor flash-off from the liquid remaining in the clearance volume of the pumping chamber when the pressure in the pumping chamber is reduced during the suction stroke. The clearance volume is that portion of the pumping chamber that is not filled by the plunger at the end of the discharge stroke. Vapor flash-off limits the amount of liquid that can subsequently enter the pumping chamber during the suction stroke and thereby reduces the volumetric efficiency of the pump. Indeed sufficient vapor flash-off may even cause the pump to become vapor bound and lose prime.

Moreover, the increased vapor flash-off increases the required NPSH of the high flow and high pressure cryogenic pump, since the presence of this vapor increases the required subcooling of the suction liquid. In this context, the required NPSH can be thought of as the minimum pressure level at the pump suction which prevents the suction liquid from boiling in the pump. Since heating the liquid is equivalent to reducing the pressure at which the liquid boils, the temperature increase of the clearance volume liquid, caused by the heats of friction and compression, causes an increase in the required NPSH of the pump.

The present invention takes advantage of the design feature in all cryogenic reciprocating liquid pumps to allow for a controlled amount of cryogenic fluid to leak around the reciprocating piston during the discharge stroke. The leakage of fluid around the piston is conventionally referred to in the art as "blow-by" fluid. In prior art design such blow-by fluid is merely discharged from the pump body by means of a discharge vent located at some predetermined location, typically at the end of the pumping chamber opposite the cryogenic liquid inlet end. In accordance with the design of the present invention heat generated by the reciprocating piston motion and heat released in the pumping chamber is removed by collecting the blow-by liquid in a variable volume annulus formed within the pumping chamber about the piston rod of the reciprocating piston during the discharge stroke and passing such collected blow-by liquid during the suction stroke into an essentially fixed volume cooling jacket surrounding the pumping chamber in heat exchange relationship therewith, such that at least a portion of the collected liquid in the cooling jacket is caused to flash under expanding volume conditions during each consecutive discharge stroke.

Accordingly it is an object of this invention to provide a reciprocating-type pump capable of pumping a cryogenic liquid at a high pressure and a high flow rate.

It is another object of this invention to provide a reciprocating-type cryogenic pump which is capable of operating with a low pressure differential between the pumping chamber and the saturation vapor pressure of the feed liquid, i.e., at a low required net positive suction head (NPSH).

It is a further object of this invention to provide a reciprocating-type cryogenic pump which minimizes or avoids the degradative effect of frictional and compressional generated heat.

Further objects and advantages of the present invention will become apparent from the following detailed description of the invention when read in conjunction with the accompanying drawings of which:

Figure 1:
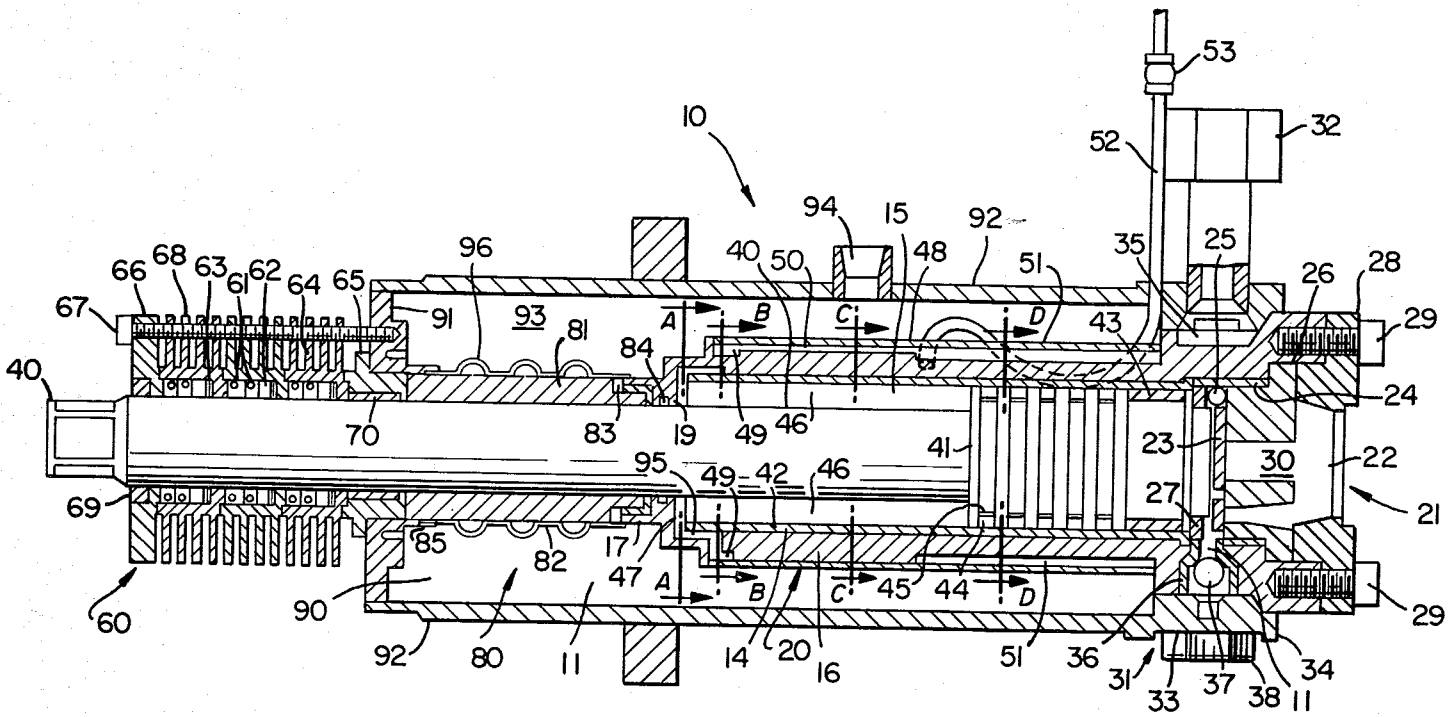
FIG. 1 is a cross-sectional view of a horizontal, reciprocating type cryogenic pump constructed in accordance with this invention.

Referring now to the drawings and in particular to FIG. 1, in which a horizontal, reciprocating-type cryogenic pump 10 is shown constructed in accordance with the preferred embodiment of the present invention. The pump 10 consists of three main subsections; the tubular pump body 20; the packing assembly 60, which seals the warm end of the pump; and an intermediate section 80, interconnecting the packing assembly 60 and the pump body 20. The construction of the intermediate section 80 and its operating relationship with the pump body 20 is described in more detail in a corresponding patent application U.S. Ser. No. 202,476 entitled "Cryogenic Reciprocating Pump" filed by applicants on even date herewith; the disclosure of which is incorporated herein by reference.

The pump body 20 is of a generally tubular construction having a cylindrical bore 14 forming a pumping chamber 15 in which a piston 41 is disposed for reciprocating motion under the reciprocating control of a piston rod 40. The piston rod 40 is coaxial with the longitudinal axis of the pump body 20 and extends outwardly from the pumping chamber 15 projecting axially through the intermediate section 80 and the packing assembly 60 where it is adapted to be connected to any conventional mechanism such as a crankshaft for effecting reciprocation of the pumping elements.

The piston rod 40 has a diameter which is of a predetermined size smaller than the diameter of the piston 41 thereby forming a predetermined variable volume annulus 46 around the piston rod 40 and within the pumping chamber 15 of the pump body 20. Cryogenic blow-by fluid leaks around the piston 41 during a discharge stroke and flows into this variable volume annulus 46.

In order to ensure trouble free operation of the pump, the piston 41 must be properly aligned within the pumping chamber. It is preferred that the bore 14 be formed in a central body 16 of stainless steel with an inner sleeve liner 42 securely mounted thereto or shrunk fit thereon and upon which the piston 41 is to ride. The inner sleeve liner may be composed of a polished type 17-4PH stainless steel. Sealing between the piston 41 and the cylindrical liner 42 is accomplished with the piston 41 outfitted with piston rings 44 preferably composed of carbonfilled teflon and energized into an activated state in biased engagement against the cylindrical liner 42 by beryllium-copper ring-type springs 45. The piston 41 is guided at its front end thereof for movement within the pumping chamber 15 by a rider ring 43 typically of carbon-filled teflon. The primary function of the rider ring 43 is to ensure proper piston positioning both during assembly and operation. The piston rod 40 is guided with an alignment bushing 70 located between the intermediate section 80 and the packing assembly 60.

Cryogenic fluid enters the cryogenic pump 10 through an inlet port 22 under the control of a suction valve assembly 21. The suction valve is of the conventional disk or plate valve type including a plate valve 23 which is laterally guided by means of a valve cage 24 and balls 25. The plate valve 23 rests on the suction valve seat assembly 26. Openings 30 are provided in the suction valve seat assembly for permitting cryogenic fluid to flow therethrough during the suction stroke. The inlet fluid can flow through openings 30 and then either around the periphery of plate valve 23 or through the plate valve perforation into the pump compression chamber. The movement of the plate valve during the suction stroke is restricted by the suction valve retainer ring 27. The entire suction valve assembly 21 is secured by a flange 28 to the pump body 20 using head bolts 29.

Cryogenic fluid is discharged through a discharge port 11 under the control of a discharge valve assembly 31. The discharge valve assembly 31 includes a discharge manifold 33 secured to the pump body 20. The discharge manifold 33 is provided with six equally spaced openings. Five of the openings are provided with the ball valve assemblies 34; while the sixth opening is fitted with the discharge connection 32. An annular discharge conduit 35 is formed between the pump body 20 and the discharge manifold 33. Five of the openings in the discharge manifold 33 are directly aligned with five openings provided in the lower portion of the pump body 20. The ball valve assemblies 34 are inserted into each of these latter openings. Each ball valve assembly 34 consists of a valve seat 36 together with a stainless steel valve ball 37. The valve seat may be held in place by threading it into the openings in the pumping chamber. The discharge valves retainer 38 permits the installation of valve seat 36 and restricts the movement of the valve ball 37. The suction valve assembly 21 and the discharge valve assembly 31 are actuated by the piston 41 in a conventional manner which will be briefly explained hereafter.

The pumping chamber 15 is sealed at the rearward end of the tubular pump body 20 by sealing the piston rod 40 with a sealing ring 84 preferably of carbon filled teflon. The sealing ring 84 is held in place by a threaded retainer ring 83 into which is fitted a spacer element 81 of teflon. The intermediate section 80 comprises the combination of the spacer element 81 and a thin walled, bellow shaped, stainless steel tubular sleeve 82 surrounding the spacer element 81. The tubular sleeve 82 is welded at one end to the member 16 of the tubular body 20 and at the opposite end thereof to a flange 91 to which the packing assembly 60 is also attached.

The packing assembly 60 seals the warm end of the cryogenic pump 10. The packing assembly consists of three sets of sealing rings 61, packing thrust washers 62 and wave washers 63. The sealing rings may be made from carbon-filled teflon. Each set of sealing rings, packing thrust washers and wave washers are installed between the individual packing glands 64. The entire packing assembly is piloted into the piston alignment bushing retainer 65, which in turn is seated in the flange 91. The packing is retained in position by the packing gland retainer 66 and the elongated head blots 67. A wiper-scraper 69 is inserted into an annular slot in the packing gland retainer 66. The packing assembly is surrounded by heat transfer fins 68 which in this embodiment are integral with the individual packing glands 64.

The entire pump body 20 is surrounded by an annular insulation means 90. The annular insulation is formed by the combination of the annular flange 91 and a pump body outer jacket 92. The pump body outer jacket is secured to the discharge manifold 33, for example by welding. The pump outer jacket 92 is spaced from the pump body tubular sleeve 48 so as to define the insulation space 93. The insulation space is preferably filled with a low conductivity material such as perlite. Additionally, the insulation space may be evacuated, as will be readily recognized by one of normal skill, to provide a vacuum insulation.

Figure 2:
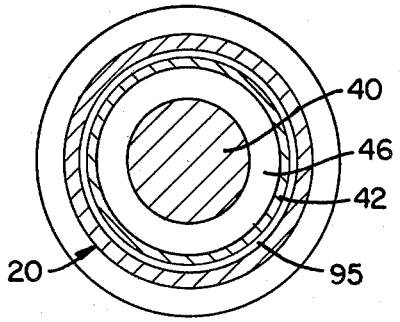
FIG. 2 is a cross-sectional view of the cryogenic pump of FIG. 1 taken along lines A—A of FIG. 1.
Figure 3:
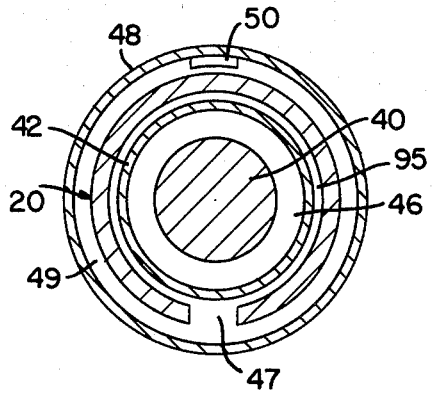
FIG. 3 is another cross-sectional view of the cryogenic pump of FIG. 1 taken along lines B—B of FIG. 1.
Figure 4:
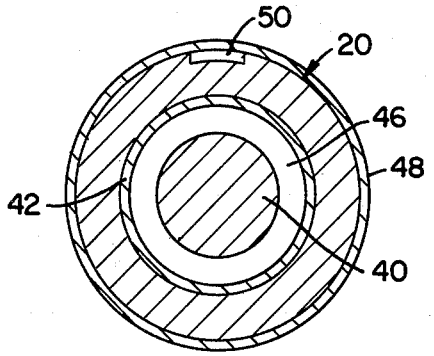
FIG. 4 is a yet another cross-sectional view of the cryogenic pump of FIG. 1 taken along the lines C—C of FIG. 1.

As explained earlier, blow by fluid is permitted to leak around the piston 41 during the discharge stroke and collects in the variable volume annulus 46 formed about the piston rod 40 between the rearward end 19 of the tubular pump body 20 and the piston 41. The cylindrical liner 42 terminates at a position within the pumping chamber 15 just short of contacting the rearward end 19 of the tubular body 20 so as to provide open clearance 47 leading to an annular passageway 95. The annular passageway 95 communicates with the annulus 49 which in turn communicates through an axially aligned groove 50 to a cooling jacket 51 as is more clearly illustrated in FIGS. 2–4.

The cooling jacket 51 completely surrounds the central pump body member 16 and liner 42 and is bounded by an outer tubular sleeve 48. The fluid is exhausted from the cooling jacket 51 through a vent 52 and through one way check valve 53. A restrictor may be used in place of the check valve 53 but is less desirable. The vent 52 should be located near the top of the cooling jacket 51 to allow for some phase separation to occur in the cooling jacket 51. The cooling jacket 51 and the passageways connecting it to the variable volume annulus 46 in combination with the exhaust vent 52 up to the check valve 53 is of a predetermined fixed volume.

In accordance with the method of the present invention the steady state operation of the pump 10 will now be described; starting with the portion of the piston 41 at the end of its discharge stroke and with the suction and discharge valves closed. As the piston 41 moves away from the suction valve assembly 21 the inlet valve 21 opens and cryogenic liquid is permitted to flow through the inlet opening into the pumping chamber 15. The discharge valve 31 remains closed because of the high pressure existing on the opposite side of the ball valve 37. As the piston 41 continues to move away from the suction valve assembly, the pumping chamber becomes filled with the cryogenic liquid. Movement of the plate valve 23 is restrained by the retainer ring 27.

Once the piston 41 reaches the limit of its suction stroke its direction of movement is reversed. Upon initiation of the discharge stroke, the compressive force exerted on the cryogenic liquid within the pumping chamber causes the suction plate valve to seat upon the valve seat assembly 26, thereby closing the suction valve assembly. As the cryogenic fluid is further compressed during the discharge stroke of the piston, the discharge valve assemblies 31 are eventually actuated. The ball valve 37 is forced outwardly to the discharge valve retainer 38 thereby establishing communication between the pumping chamber and the annular discharge conduit 35. The pressurized cryogenic liquid flowing into the annular discharge conduit is then discharged through the discharge connection 32.

Simultaneously with the discharge stroke of the pump, blow-by fluid collects in the expanding variable volume annulus 46. Since the volume of the variable volume annulus 46 is increasing much more rapidly than the volume rate of flow of the blow-by fluid into this annulus, a portion of the blow-by fluid liquid flashes (vaporizes) upon passing into the expanding annulus. Since this flashing occurs under essentially adiabatic conditions, the latent heat of vaporization must come from the sensible heat content of the liquid itself. Consequently, the temperatures of the liquid remaining in the expanding annulus decreases. This cooled liquid helps to remove both the frictional and compressional heat generated within the pumping chamber. Moreover, this liquid also helps to remove heat conducted along the piston from the warm end of the pump.

As the piston returns to the position illustrated in FIG. 1, the discharge valve once again closes. The pump cycle is then repeated. During the subsequent suction stroke, any blow-by fluid that has collected in the previously expanding variable volume annulus is now forced to flow therefrom as the annulus begins to contract. This fluid is pushed through the open clearance 47 into the annular space 95 from whence it flows up and around the annulus 49, through the axially extending conduit 50 and into the cooling jacket 51. Upon entering the cooling jacket 51 and gas and liquid phases of the fluid tend to separate and the gas collects in the upper region of the cooling jacket 51. Some blow-by gas separated in the cooling jacket from a previous pumping cycle is then forced by this new fluid through the vent conduit 52 and past the check valve 53. This gas may be returned to the source of the cryogenic liquid or may be vented to the atmosphere. The venting of blow by fluid from the cooling jacket 51 is controlled by the check valve 53 which prevents back flow into the cooling jacket. Where a restrictor is used in place of the check valve it must function to prevent back flow at a rate greater than the difference between the rate of expansion of the variable volume annulus and the blow by fluid flow rate into the variable volume annulus.

At the end of the suction stroke, the cooling jacket is substantially filled with the blow-by liquid. As the discharge stroke is begun, the volume of the interconnected annular cooling jacket and variable volume annulus expands rapidly. Since there is a very small pressure drop between the expanding annulus and the cooling jacket, gas is drawn from the fixed volume cooling jacket thereby lowering the pressure therein. This pressure reduction causes the blow-by liquid within the annular cooling jacket to boil. Since this boiling occurs under essentially adiabatic conditions, the latent heat of vaporization must come from the sensible heat content of the fluid itself. Consequently, the temperature of the liquid within the cooling jacket decreases. This so-cooled fluid then acts as an additional heat-sink for the frictional and compressional heat generated during the operation of the pump.

As one can see, this invention in effect relies upon two sequential expansions of blow-by liquid to help remove the heats of friction and compression generated during pump operation. In the first case, the blow-by liquid is expanded into the expanding variable volume annulus from the pumping chamber during a discharge stroke of the pump. The residual liquid is thereafter forced into the cooling jacket during a suction stroke. This liquid is then expanded once again on the subsequent discharge of the pump. As a result of these operations, the pumping chamber will be surrounded with a cooled cyrogenic liquid. The liquid may be at a temperature below the temperature of the suction liquid. This operation significantly improves pump performance.

In accordance with the present invention the variable volume annulus 46 should provide a fully expanded volume proportional to the fixed volume of the blow-by fluid vent passageways from the annulus 46 to the check valve 53 including the fixed volume of the cooling jacket 51. Preferably, the volume of the fluid vent passageways and cooling jacket 51 should lie between about 0.1 to 10 times the volume of the fully expanded variable volume annulus.

Figure 5:
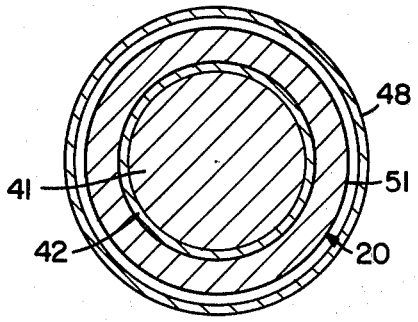
FIG. 5 is an even further cross-sectional view of the cryogenic pump of FIG. 1 taken along the lines D—D of FIG. 1.
Figure 6:
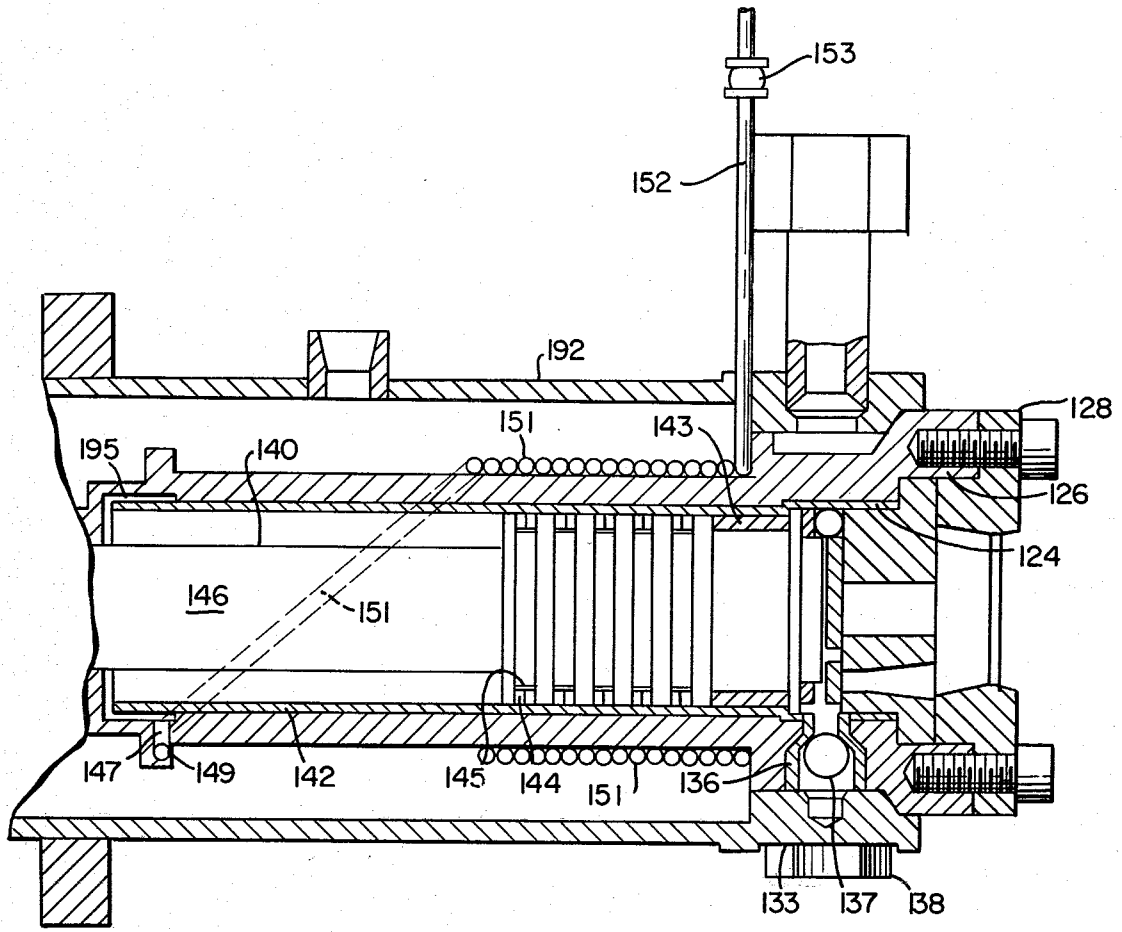
FIG. 6 is a view of another embodiment of the invention illustrating in cross-section a portion of the cryogenic pump.

While the cooling jacket 51 of the present invention is illustrated as simply an annular cavity surrounding the pumping chamber, many other designs are possible as will be realized by one of ordinary skill. FIG. 5 illustrates an alternative embodiment. In FIG. 5, elements similar to those elements in FIG. 1 are given the same reference numeral increased by 100. In this embodiment, the cooling jacket consists of a single tube or conduit helically wrapped around the pump body 120 so as to establish an intimate heat exchange relationship with the pump body 120. The tube 151 is connected to the variable volume annulus 146 by means of the annular space 195 and annulus 149. The lower or opposite end of the tube 151 extends outwardly through the annular insulation space and is provided with the check valve 153. Operation of this embodiment is analogous to the FIG. 1 embodiment. Please note, however, that the cooling effect in the cooling jacket 151 accompanying the expansion of the variable volume annulus may not be as pronounced as in the FIG. 1 embodiment. A higher pressure drop between the cooling jacket and the expanding annulus, a higher volume ration between the cooling jacket and the expanding annulus and an incomplete separation of liquid and gas in the cooling jacket may all contribute to this result and not prove as effective in subcooling the pumping chamber.

Although preferred embodiments of this invention have been described in detail, it will be appreciated that other embodiments are contemplated along with modifications of the disclosed features as being within the scope of the invention.

We claim:

1. A method for pumping cryogenic liquids using a reciprocating cryogenic pump having a cylindrical pumping chamber in which a piston is reciprocated by a piston rod having a diameter smaller than the diameter of said piston comprising the steps of:

(a) introducing cryogenic liquid into said pumping chamber during each suction stroke of said piston and discharging said cryogenic liquid from said pumping chamber during each discharge stroke of said piston;

(b) collecting blow by fluid during each discharge stroke in a variable volume annulus formed within the pumping chamber about said piston rod;

(c) passing said blow by fluid during each suction stroke from said variable volume annulus into a cooling jacket of substantially fixed volume with said cooling jacket being arranged about said pumping chamber in heat exchange relationship therewith, and (d) expanding said collected blow by fluid in said cooling jacket during each consecutive discharge stroke such that at least a portion of said collected blow by fluid is caused to flash during each such consecutive discharge stroke whereby the pumping chamber is cooled through heat exchange with the cooling jacket.

2. A method as defined in claim 1 wherein said cooling jacket is arranged in an annulus surrounding said pumping chamber to cause said collected blow by fluid in said cooling jacket to separate into a gas and liquid phase and further comprising the step of venting the separated gas during each consecutive discharge stroke.

3. A method as defined in claim 2 further comprising the step of venting blow by fluid from said cooling jacket through a check valve.

4. A method as defined in claim 3 wherein said cooling jacket is connected through a passageway to said variable volume annulus with the volume of said cooling jacket and passageway being not more than ten times the maximum volume provided by said variable volume annulus.

5. A method as defined in claim 4 wherein the volume of said cooling jacket including said passageway is no more than between 10–100% of the maximum volume provided by said variable volume annulus.

6. A cryogenic reciprocating pump for pumping cryogenic liquids at high pressure and flow rate comprising: a pump body having a cylindrical bore forming a pumping chamber in which a piston is slidably disposed, said pumping chamber having a forward end and a rearward end; a piston rod for reciprocating said piston between the forward and rearward end at said pumping chamber, said piston rod extending axially form said piston through said rearward end of said chamber and having a diameter smaller than the diameter of said piston for forming a variable volume annulus within said pumping chamber about said piston rod; valve means disposed at the forward end of said pumping chamber for controllably introducing cryogenic liquid into said puming chamber during each suction stroke and for controllably discharging cryogenic liquid from said pumping chamber during each discharge stroke; a cooling jacket of substantially fixed volume surrounding said pumping chamber in a heat exchange relationship therewith; passageway means communicating between said variable volume annulus and said cooling jacket for passing cryogenic fluid into said cooling jacket during each suction stroke and vent means for controllably venting cryogenic fluid from said cooling jacket such that at least a portion of the cryogenic liquid passed into said cooling jacket during each suction stroke is caused to flash during each subsequent discharge stroke.

7. A cryogenic reciprocating pump as defined in claim 6 wherein said vent means comprises a discharge conduit and a check valve for preventing back flow into the cooling jacket.

8. A cryogenic reciprocating pump as defined in claim 6 wherein said vent means comprises a discharge conduit and means for restricting back flow through said discharge conduit into said cooling jacket.

9. A cryogenic reciprocating pump as defined in claim 7 wherein said cooling jacket comprises an annulus formed within said pump body around said pumping chamber and extending longitudinally from a location substantially about said forward end over a substantial surface area of said pumping chamber.

10. A cryogenic reciprocating pump as defined in claim 9 wherein said passageway means comprises an opening leading into said variable volume annulus adjacent the rearward end of said pumping chamber, and conduit means coupling said opening to said cooling jacket.

11. A cryogenic reciprocating pump as defined in claim 10 further comprising a cylindrical sleeve liner contiguous to the inside surface of the cylindrical bore and upon which said plunger rides, said cylindrical sleeve liner extending longitudinally from said forward end of said pumping chamber to a location displaced from said rearward end to form said opening.

* * * * *